US006640077B2

(12) United States Patent
Suzuki et al.

(10) Patent No.: US 6,640,077 B2
(45) Date of Patent: Oct. 28, 2003

(54) IMAGE FORMING APPARATUS

(75) Inventors: Shinya Suzuki, Ibaraki (JP); Haruhiko Omata, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/076,496

(22) Filed: Feb. 19, 2002

(65) Prior Publication Data

US 2002/0159800 A1 Oct. 31, 2002

(30) Foreign Application Priority Data

Feb. 20, 2001 (JP) ..... 2001-043816

(51) Int. Cl.[7] ..... G03G 15/00
(52) U.S. Cl. ..... 399/303; 271/7; 474/92
(58) Field of Search ..... 397/98, 99, 101, 397/303, 312, 71; 198/493, 494, 496; 474/92; 271/7

(56) References Cited

U.S. PATENT DOCUMENTS 6,292,637 B1 * 9/2001 Lindblad et al. ..... 399/99

* cited by examiner

*Primary Examiner*—Joan Pendegrass
(74) *Attorney, Agent, or Firm*—Fitzpatrick, Cella, Harper & Scinto

(57) ABSTRACT

In an image forming apparatus wherein the slip of a transporting belt relative to a driving device due to a change in the surface state the inner surface of the transporting belt and a bad image can be reliably prevented, and having a photosensitive drum on the surface of which a toner image is formed, a transfer belt and a driving roller for driving the transfer belt, wherein the toner image formed on the surface of the photosensitive drum is transferred onto the transfer belt or a recording material borne on the transfer belt, an abrasive roller is provided at a position, in contact with a surface on which the driving roller abuts against the transfer belt.

17 Claims, 5 Drawing Sheets

IMAGE FORMING APPARATUS

BACKGROUND OF THE INVENTION

1. Field of the Invention

The present invention relates to an image forming apparatus for forming a toner image on a photosensitive member, and transferring the toner image to a transporting belt or a recording material borne on the transporting belt to thereby obtain an image.

2. Description of Related Art

There have heretofore been proposed various image forming apparatuses which are provided with a plurality of image forming portions, wherein toner images of different colors are formed in the respective image forming portions, and the toner images then are sequentially superimposed and transferred onto the same recording material to thereby form a color image. For high-speed recording, use is made of a color copier of the multi-color electrophotographic type using an endless transfer belt.

There also have been proposed various image forming apparatuses of the intermediate transfer type, in which toner images first are transferred onto an intermediate transfer member, and thereafter are transferred to a transfer material to thereby form a color image.

Among these image forming apparatuses, there is one using as the transfer belt a sheet of polycarbonate or the like having its opposite ends connected together to form an endless belt. In such a product, the long-term use thereof causes the seam to break.

Recently, however, seamless transfer belts have come to be manufactured and the lengthening of their service life has been advanced.

However, with the lengthening of the service life of the transporting belt in the aforedescribed image forming apparatus according to the conventional art, a change in the surface state of the transporting belt due to the long-term use thereof has become remarkable. As causes thereof, mention may be made of, for example, the filming phenomenon that occurs when toners are secured to the surface of the transporting belt, and the fact that the surface of the transporting belt is abraded by a cleaning member or the like abutting against the transporting belt. A change in the surface state occurs not only to the outer surface of the transporting belt (i.e., the surface on which toner images or the transfer material is borne), but also to the inner surface thereof (i.e., the surface contacted by a driving roller for driving the transporting belt).

The coefficient of friction of the transporting belt and the driving roller is changed by such a change in the surface state. Slight slippage is caused during the movement of the transporting belt, and the moving speed thereof becomes unstable. Thereby, deviations occur in the transferred positions of the toner images. Particularly, in the case of a tandem type image forming apparatus provided with multiple sets of photosensitive members for the respective colors of the toners, if the moving speed of the transporting belt is unstable, toner images of the respective colors are not correctly superimposed one upon another, with a result that so-called color misregistration occurs and the quality of image is remarkably deteriorated.

As the endurance change further progresses, the transporting belt becomes incapable of being driven. Also, when the volume resistivity of the transporting belt is changed by the filming phenomenon of the toners on the inner surface of the transporting belt, it will present itself as an uneven image and a good image cannot be obtained.

SUMMARY OF THE INVENTION

The present invention has been made in view of the above-noted problem and the object thereof is to provide an image forming apparatus in which slippage of a transporting belt relative to driving means due to a change in the surface state of the inner surface of the transporting belt, and resultant bad images, can be reliably prevented.

In order to achieve the above object, in an image forming apparatus having a photosensitive member on the surface of which a toner image is to be formed, a transporting belt and driving means for driving the transporting belt, and wherein a toner image formed on the surface of the photosensitive member is to be transferred onto the transporting belt or a recording material borne on the transporting belt, abrading means is provided at a position in contact with a surface on which the driving means abuts against the transporting belt.

Provision may be made of detecting means for detecting the surface roughness of the surface of the transporting belt against which the driving means abuts, and the abrading means may be operated on the basis of the result of the detection by the detecting means.

The abrading means may be comprised of an abrading roller.

The abrading means may be comprised of a brush.

The abrading means may preferably operate so that the surface roughness of the transporting belt may be maintained within such a range that a ten-point mean roughness Rz is 3 to 25 $\mu$m.

DESCRIPTION OF THE PREFERRED EMBODIMENTS

Preferred embodiments of the present invention will hereinafter be described with reference to the accompanying drawings.

EMBODIMENT 1

Figure 1:
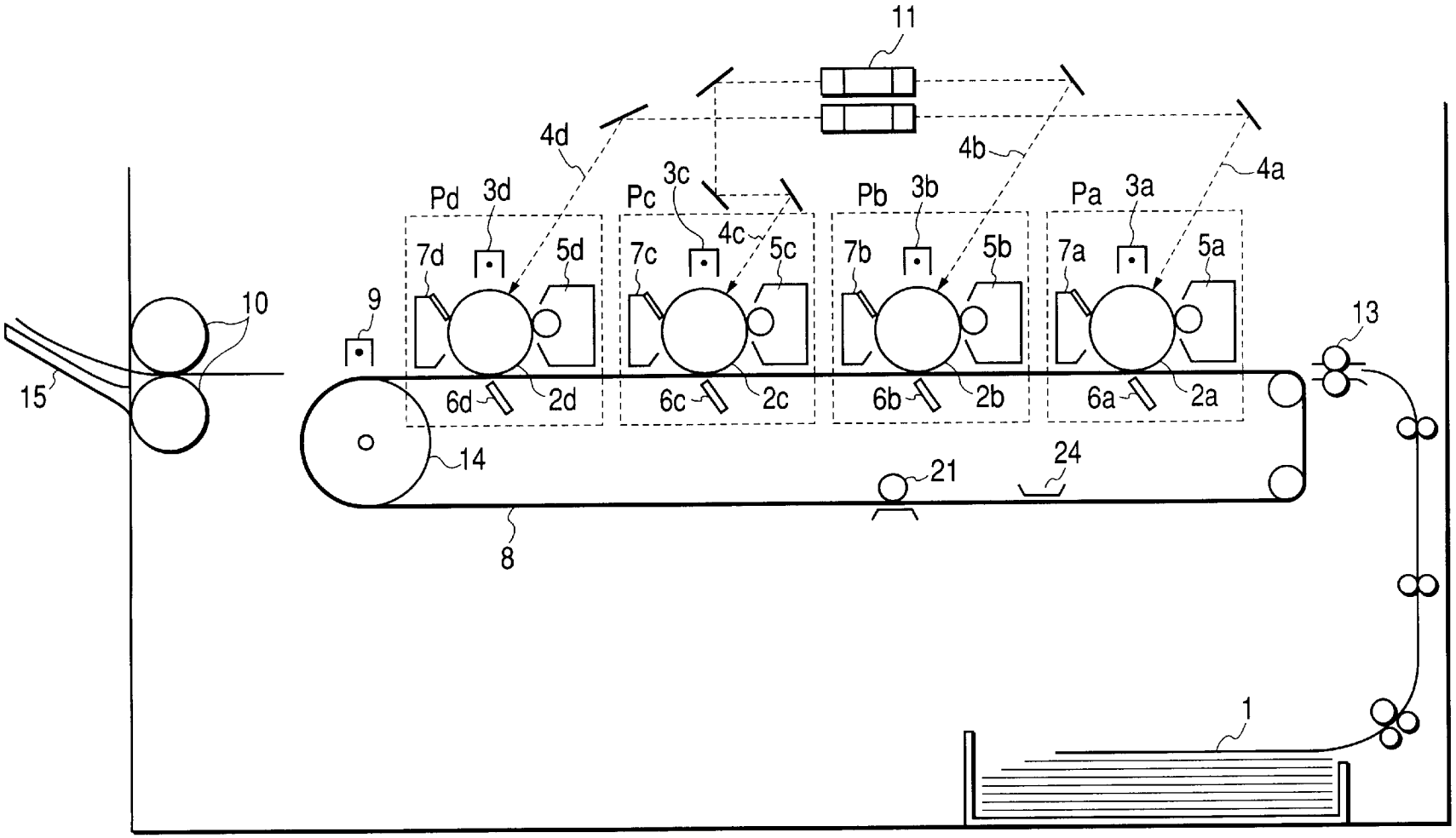
FIG. 1 is a schematic cross-sectional view of an image forming apparatus according to Embodiment 1 of the present invention.

FIG. 1 schematically shows the construction of an image forming apparatus according to Embodiment 1 of the present invention. In FIG. 1, first, second, third and fourth image forming portions, Pa, Pb, Pc and Pd, are juxtaposed in the image forming apparatus, and cyan, magenta, yellow and black toner images are successively formed by way of latent image forming, developing and transferring processes.

The image forming portions Pa, Pb, Pc and Pd are provided with electrophotographic photosensitive drums 2*a*, 2*b*, 2*c* and 2*d*, respectively, which are image bearing members exclusively for use therewith, and a transfer belt 8, which is a recording material bearing member, is installed adjacent to the photosensitive drums 2*a*, 2*b*, 2*c* and 2*d*, and toner images of the respective colors formed on the photosensitive drums 2*a*, 2*b*, 2*c* and 2*d* are transferred onto a recording material 1 borne and transported by the transfer belt 8. The recording material 1, onto which the toner images of the respective colors have been transferred, is stripped from the transfer belt 8 by a stripping charger 9, and is subjected to the fixing of the toner images by heat and pressure in a fixing device 10, and thereafter is delivered as a recorded image out of the apparatus.

Around the respective photosensitive drums 2*a*, 2*b*, 2*c* and 2*d*, there are provided drum chargers 3*a*, 3*b*, 3*c*, 3*d*, developing devices 5*a*, 5*b*, 5*c*, 5*d*, transfer chargers 6*a*, 6*b*, 6*c*, 6*d* and cleaners 7*a*, 7*b*, 7*c*, 7*d*, and in the upper portion of the apparatus, there are installed a light source device (not shown) and a polygon mirror 11.

An exposing device rotates the polygon mirror 11 to thereby scan a laser beam emitted from the light source device, and deflects light beams 4*a*, 4*b*, 4*c* and 4*d* of the scanned beam using a reflecting mirror, and condenses them on the generatrices of the photosensitive drums 2*a*, 2*b*, 2*c* and 2*d* using an fθ lens and exposes the drums to the light, whereby latent images conforming to an image signal are formed on the photosensitive drums 2*a*, 2*b*, 2*c* and 2*d*.

The developing devices 5*a*, 5*b*, 5*c* and 5*d* are filled with predetermined amounts of cyan, magenta, yellow and black toners, respectively, as developers, using a supply device (not shown). The developing devices 5*a*, 5*b*, 5*c* and 5*d* develop latent images on the photosensitive drums 2*a*, 2*b*, 2*c* and 2*d*, respectively, and visualize them as a cyan toner image, a magenta toner image, a yellow toner image and a black toner image.

Recording materials 1 are contained in a recording material cassette 12, and are supplied one by one from the cassette 12 onto the transfer belt 8 via a plurality of transporting rollers and a pair of registration rollers 13, and are sequentially sent to transferring portions opposed to the photosensitive drums 2*a*, 2*b*, 2*c* and 2*d* by the transportation by the transfer belt 8.

The transfer belt 8 is comprised of a dielectric material resin sheet such as a polyethylene terephthalate resin sheet (PET resin), a polyvinylidene fluoride resin film sheet or a polyurethane resin sheet. The belt has its opposite end portions superimposed and joined together to form an endless loop shape, or a seamless belt.

The transfer belt 8 is rotated by a driving roller 14. The recording material 1 is fed from the registration rollers 13 to the transfer belt 8, and the recording material 1 is transported toward the transferring portion of the first image forming portion Pa. At the same time, an image writing signal is turned ON and, with the signal "on" as a reference, at certain timing, image formation is effected on the photosensitive drum 2*a* of the first image forming portion Pa by modulation of the signal.

Then, in the transferring portion under the photosensitive drum 2*a*, the transfer charger 6*a* imparts an electric field or charges to the photosensitive drum 2*a*, whereby the toner image of the first color formed on the photosensitive drum 2*a* is transferred onto the recording material 1. By this transfer, the recording material 1 is firmly held on the transfer belt 8 by electrostatic attraction, and is transported to the second image forming portion Pb and subsequent image forming portions.

The transfer charger 6, is a contact charger using a transfer charging member such as a blade, a roller or a brush. The contact charger has such merits as being ozoneless, being strong against the fluctuation of temperature and humidity environment, and providing a high quality of image.

The image formation and transfer in the second to fourth image forming portions Pb to Pd are also effected in the same manner as in the first image forming portion Pa. Then, the recording material 1 to which the toner images of the four colors have been transferred has its charges eliminated by the stripping charger 9 downstream of the transfer belt 8 in the direction of transportation and is decayed in electrostatic attraction, whereby the recording material 1 is stripped from the distal end of the transfer belt 8. Particularly in a low-humidity environment, the recording material 1 is dry and becomes high in electrical resistance and therefore, the electrostatic attraction thereof with respect to the transfer belt 8 becomes great, and the effect of the stripping charger 9 becomes great. Usually, the stripping charger is a non-contact charger because the stripping charger charges the recording material with the toner images thereon remaining unfixed.

The stripped recording material 1 is transported to the fixing device 10, where the color mixing and fixing of the toner images to the recording material 1 are effected, and the recording material 1 now with a full-color copy image formed thereon is delivered onto a delivery tray 15.

Abrading means will now be described.

Figure 2:
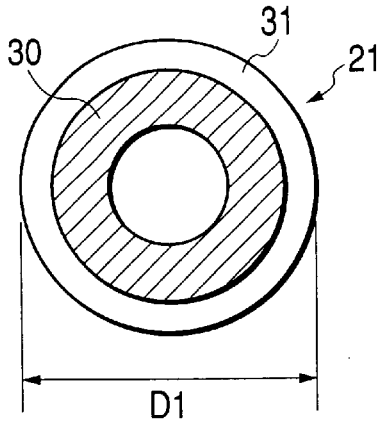
FIG. 2 is a transverse cross-sectional view of an abrading roller.
Figure 3:
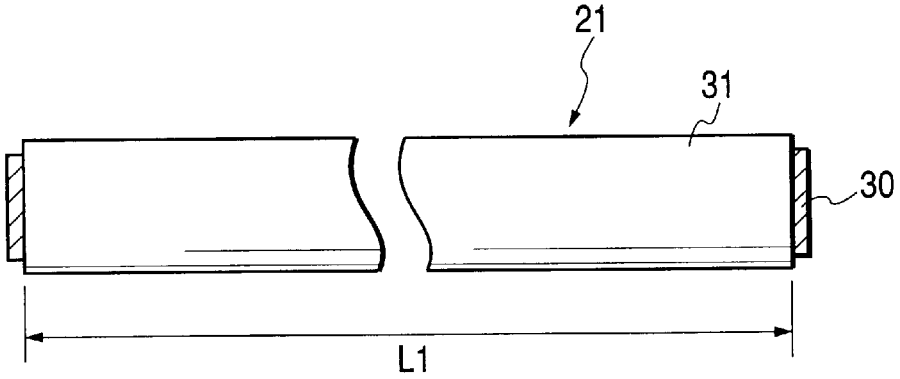
FIG. 3 is a side view of the abrading roller.

An abrasive roller 21 is provided downstream of a charge eliminating roller in the direction of movement of the transfer belt so as to contact with the inner surface of the transfer belt 8. As shown in FIGS. 2 and 3, the abrasive roller 21 is comprised of an aluminum pipe 30 which is a base material and an abrasive sheet 31 wound around it.

The abrasive sheet 31 is made of Lapping Film (produced by 3M, Ltd.). Lapping Film is comprised of a resin sheet and alumina particles as an abrading agent uniformly secured to the surface thereof. The diameter D1 of the abrasive roller 21 is set to 20 mm, and the length L1 in the longitudinal direction thereof is set to 300 mm. The abrading roller 21 is supported for rotation about the longitudinal axis of the aluminum pipe 30 by a motor (not shown) and is designed to be rocked by an eccentric cam (not shown) so as to be brought into contact with and separated from the transfer belt 8.

Also, abrasion waste is produced as the inner surface of the transfer belt 8 is abraded and therefore, an inner surface cleaning member 24 is provided downstream of the abrading roller 21 in the direction of movement of the transfer belt. Felt is used as the material of the inner surface cleaning member 24, and the inner surface cleaning member 24 is always in contact with the inner surface of the transfer belt 8.

In the present embodiment, the abrasive roller 21 is designed to be operated when the number of copy sheets from the previous abrading operation exceeds 5,000 sheets and when an image forming operation has been terminated. Design is made such that during the operation of the abrasive roller 21, the main body of the apparatus enters a standby state and cannot perform an image forming operation. This is because, if an abrading operation for the inner surface of the transfer belt 8 occurs during image formation, a bad image, such as one having color misregistration, is caused by shock which occurs when the abrasive roller 21 contacts the transfer belt 8.

Figure 4:
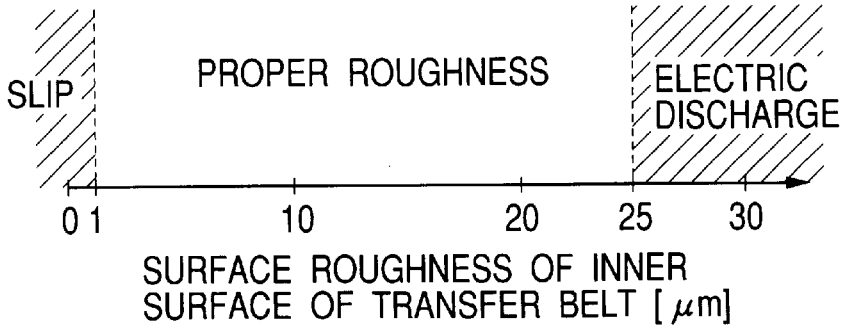
FIG. 4 shows the relation between the surface roughness of the inner surface of a transfer belt and an evil accompanying it.

FIG. 4 shows the relation between the surface roughness of the inner surface of the transfer belt 8 and an evil accompanying it.

When due to the filming phenomenon that scattered toners or the like are secured in the form of film and the abrasion of the transfer belt 8 by the friction with the members contacting with the transfer belt 8, the surface roughness (ten-point mean roughness) Rz of the inner surface of the transfer belt 8 becomes smaller than 1 $\mu$m, the driving roller 14 and the inner surface of the transfer belt 8 slip relative to each other and the transfer belt 8 cannot be rotated and thus, image formation cannot be effected. Conversely, when the surface roughness Rz of the inner surface of the transfer belt 8 is made greater than 25 $\mu$m, a high transfer voltage is applied to the transfer blades 6*a* to 6*d* particularly under a low-humidity environment, whereby electric discharge occurs at the gaps between the inner surface of the transfer belt 8 and the transfer blades 6*a* to 6*d*, and a resultant bad image occurs. In the present embodiment, design is made such that the inner surface of the transfer belt 8 is roughened to the order of 15 $\mu$m.

The direction of rotation of the abrasive roller 21 relative to the transfer belt 8 and the number of revolutions necessary to effect good abrasion can be determined on the basis of an experimentally obtained result as shown in Table 1 below.

TABLE 1

| rotating speed of abrasive roller (rpm) | necessary number of revolutions of abrasive roller: forward direction | necessary number of revolutions of abrasive roller: reverse direction |
|---|---|---|
| 250 | 80 revolutions or more | 65 revolutions or more |
| 500 | 50 revolutions or more | 40 revolutions or more |
| 1000 | 30 revolutions or more | 25 revolutions or more |

Figure 5:
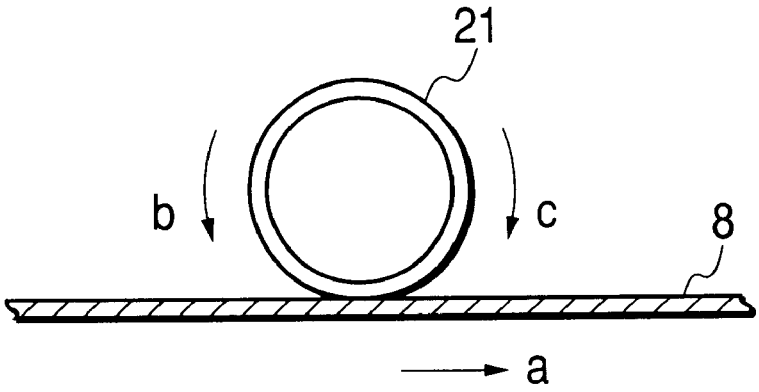
FIG. 5 is an illustration of the direction of rotation of the abrading roller in Table 1.

In Table 1, when in order to roughen the inner surface of the transfer belt 8 to 15 $\mu$m, the abrasive roller 21 is rotated in a forward direction at total pressure of 500 g and at a rotating speed of 500 rpm, fifty (50) revolutions is regarded as being suitable. The forward direction of the abrasive roller 21, as shown in FIG. 5, is the direction of rotation indicated by the arrow "b" when the transfer belt 8 is rotated in a direction indicated by the arrow "a", and the reverse direction of the abrasive roller 21 is the direction of rotation indicated by the arrow "c". In the present embodiment, design is made such that the abrasive roller 21 is rotated by 50 revolutions at 500 rpm in the forward direction.

As described above, under predetermined conditions, the inner surface of the transfer belt 8 is abraded by the abrasive roller 21 to thereby prevent slippage of the transfer belt 8 and the driving roller 14 relative to each other, and toner particles secured to the inner surface of the transfer belt 8 due to the filming phenomenon are scraped off, whereby a change in the volume resistivity of the transfer belt 8 can be prevented and a bad image, such as a resultant uneven image, can be prevented.

Figure 6:
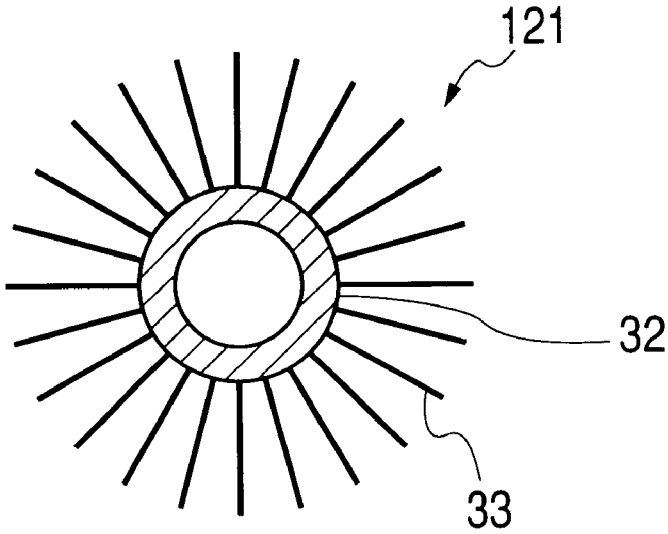
FIG. 6 is a side view of a wire brush.

Also, as alternative abrading means, use may be made of a wire brush 121 as shown in FIG. 6. The wire brush 121 is comprised of a core member 32 and a brush member 33 implanted around the core member 32. As the material of the brush member 33, use is made of one having hardness and rigidity capable of abrading the transfer belt 8. By thus adopting the wire brush 121 as the abrasive member for the inner surface of the transfer belt 8, an effect similar to what has been previously described can be obtained.

EMBODIMENT 2

Figure 7:
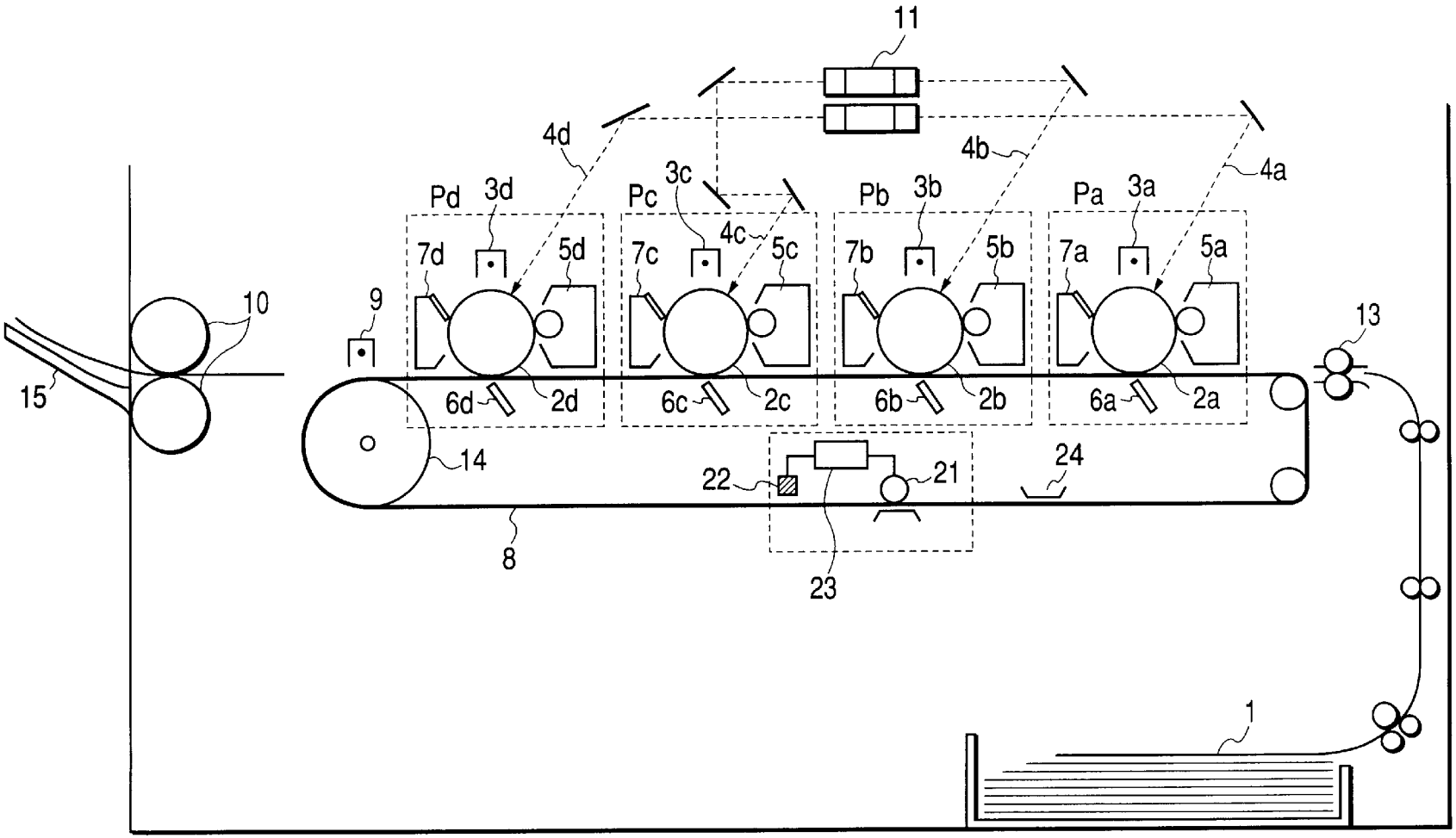
FIG. 7 is a schematic cross-sectional view of an image forming apparatus according to Embodiment 2 of the present invention.

Embodiment 2 of the present invention will now be described with reference to FIGS. 7 and 8.

In the embodiment, detecting means 22 for detecting the surface roughness of the inner surface of the transfer belt 8 is provided upstream of the abrasive roller 21 in the direction of rotation of the transfer belt.

Design is made such that when it is detected that the surface roughness of the inner surface of the transfer belt 8 is smaller than a predetermined value, a signal is output by a control device 23 connected to the detecting means 22 so that the abrasive roller 21 may contact the inner surface of the transfer belt 8. When an image forming operation is terminated, the abrasive roller 21 effects the abrasion of the inner surface of the transfer belt 8 so as to make the inner surface of the transfer belt 8 have predetermined roughness.

During operation of the abrasive roller 21, the main body of the apparatus enters its standby state, so that an image forming operation cannot be performed. This is because, if an abrading operation for the inner surface of the transfer belt 8 occurs during image formation, a bad image, such as one having color misregistration, will occur due to shock that occurs when the abrasive roller 21 contacts the transfer belt 8.

Figure 8:
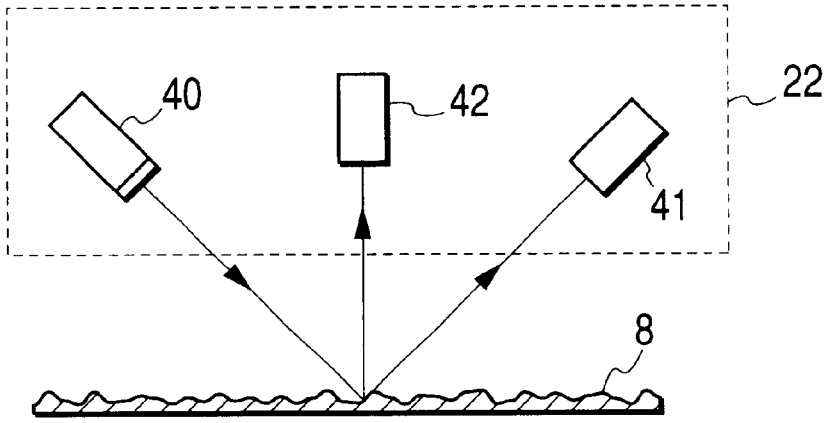
FIG. 8 shows the construction of detecting means for detecting the surface roughness of the transfer belt.

FIG. 8 shows the detecting means 22 for detecting the surface roughness of the inner surface of the transfer belt 8.

As shown in FIG. 8, light is emitted from a light emitting element 40 to the inner surface of the transfer belt 8, and regular reflection light is received by a first light receiving element 41 and diffuse reflection light is received by a second light receiving element 42. The quantities of reflection light detected by the first and second light receiving elements 41 and 42 are compared with each other to thereby detect the surface roughness.

When the surface roughness of the inner surface of the transfer belt 8 is great, the value of the quantity of regular reflection light detected by the first light receiving element 41 is small and the value of the quantity of diffuse reflection light detected by the second light receiving element 42 is great. Conversely, when the surface roughness of the inner surface of the transfer belt 8 is small, the value of the quantity of regular reflection light detected by the first light receiving element 41 is great and the value of the quantity of diffuse reflection light detected by the second light receiving element 42 is small. Depending on the result of the surface roughness detected in this manner, the contact or separation of the abrasive roller 21 is effected.

Thus, again in the present embodiment, as in Embodiment 1, slippage of the transfer belt 8 and the driving roller 14 relative to each other is prevented, and toner particles secured to the inner surface of the transfer belt 8 due to the filming phenomenon are scraped off, whereby a change in the volume resistivity of the transfer belt 8 is prevented and the occurrence of a bad image, such as a resultant uneven image, is prevented. Also, by detecting the surface roughness of the inner surface of the transfer belt 8, the inner surface of the transfer belt 8 can be stably rendered within a proper range of surface roughness.

As is apparent from the foregoing description, according to the present invention, in an image forming apparatus having a photosensitive member on the surface of which a toner image is to be formed, a transfer belt or a transporting belt, and driving means for driving the transporting belt, a wherein toner image to be formed on the surface of the photosensitive member is transferred onto the transporting belt or a recording material borne on the transporting belt, abrading means is provided in a position in which the abrading means can be brought into contact with a surface of the transporting belt against which the driving means abuts. In this manner, slippage of the belt relative to the driving means due to a change in the surface state of the inner surface of the belt, and a resultant bad image, can be reliably prevented.

What is claimed is:

1. An image forming apparatus comprising:

a photosensitive member;

a transporting belt;

driving means for driving said transporting belt or a recording material borne by said transporting belt to a toner image transfer portion between said photosensitive member and said transporting belt; and abrading means provided at a position in which said abrading means can be brought into contact with a surface of said transporting belt against which said driving means abuts.

2. An image forming apparatus according to claim 1, further comprising detecting means for detecting a surface roughness of the surface of said transporting belt against which said driving means abuts, wherein said abrading means is operated on the basis of a detection result of said detecting means.

3. An image forming apparatus according to claim 1 or 2, wherein said abrading means is an abrasive roller.

4. An image forming apparatus according to claim 1 or 2, wherein said abrading means is a brush.

5. An image forming apparatus according to claim 1 or 2, wherein said abrading means operates so that a surface roughness of said transporting belt has a ten-point mean roughness Rz ranging from 3 $\mu$m to 25 $\mu$m.

6. A sheet transporting apparatus comprising:

a transporting belt for transporting a sheet;

a driving rotary member for driving said transporting belt; and friction coefficient increasing means for increasing a coefficient of friction of said transporting belt relative to said driving rotary member, wherein said friction coefficient increasing means increases a surface roughness of said transporting belt.

7. A sheet transporting apparatus according to claim 6, further comprising detecting means for detecting a surface roughness of said transporting belt, and control means for controlling said friction coefficient increasing means on the basis of a detection result of said detecting means.

8. A sheet transporting apparatus according to claim 6, wherein said transporting belt is an endless belt, and said friction coefficient increasing means acts on an inner peripheral surface of said transporting belt.

9. A sheet transporting apparatus according to claim 6, wherein said transporting belt is disposed in a position in which said transporting belt is opposed to an image bearing member for bearing a toner image, and said transporting belt transports the sheet so as to transfer the toner image on the image bearing member to the sheet.

10. A sheet transporting apparatus comprising:

a transporting belt that transports a sheet;

a driving rotary member that drives said transporting belt; and a friction coefficient increasing portion that increases a coefficient of friction of said transporting belt relative to said driving rotary member, wherein said friction coefficient increasing portion increases a surface roughness of said transporting belt.

11. A sheet transporting apparatus according to claim 10, further comprising a detecting portion that detects a surface roughness of said transporting belt, and a controller that controls said friction coefficient increasing portion on the basis of a detection result of said detecting portion.

12. A sheet transporting apparatus according to claim 10, wherein said transporting belt is a seamless belt, and said friction coefficient increasing portion acts on an inner peripheral surface of said transporting belt.

13. A sheet transporting apparatus according to claim 10, wherein said transporting belt is disposed in a position in which said transporting belt is opposed to an image bearing member that bears a toner image, and said transporting belt transports the sheet so as to transfer the toner image borne on the image bearing member to the sheet.

14. An image forming apparatus comprising:

a photosensitive member on a surface of which a toner image is to be formed;

a belt positioned in contact with said photosensitive member;

a driving rotary member that drives said belt; and a friction coefficient increasing portion positioned in contact with a backside of said belt so as to increase a surface roughness of said belt.

15. An image forming apparatus according to claim 14, wherein plural photosensitive members respectively, are provided in plural positions.

16. An image forming apparatus according to claim 14, wherein said friction coefficient increasing portion increases a friction coefficient to a value equal to or greater than a value at which said driving rotary member and an inner surface of said belt do not slip relative to each other.

17. An image forming apparatus according to claim 14, further comprising a transfer portion that transfers the toner image formed on the surface of said photosensitive member to a sheet borne on said belt, wherein said friction coefficient increasing portion does not increase a friction coefficient to a value equal to or greater than a value at which electric discharge occurs in a gap between said belt and said transfer portion.

* * * * *